US005988068A

United States Patent [19]

Van Ritter et al.

[11] Patent Number: 5,988,068

[45] Date of Patent: Nov. 23, 1999

[54] METHOD AND APPARATUS FOR DECORATING CERAMIC AND GLASS SUBSTRATES AND THE TONER POWDER USED IN SUCH A SYSTEM

[75] Inventors: Hendrik R.P. Van Ritter, Eindhoven; Rainier F.X.A.M. Mols, Venlo, both of Netherlands

[73] Assignee: Oce-Nederland, B.V., Venlo, Netherlands

[21] Appl. No.: 08/943,185

[22] Filed: Oct. 3, 1997

[30] Foreign Application Priority Data

Oct. 3, 1996 [NL] Netherlands ..... 1004179

[51] Int. Cl.[6] ..... B41L 35/14

[52] U.S. Cl. ..... 101/488; 101/483

[58] Field of Search ..... 101/488, 483, 101/35, 487, 171, 173, 175, 177, DIG. 37, DIG. 48

[56] References Cited

U.S. PATENT DOCUMENTS

| | | | |
|---|---|---|---|
| 3,698,314 | 10/1972 | Grier | 101/487 |
| 4,187,774 | 2/1980 | Masakazu et al. | 101/1 |
| 5,045,697 | 9/1991 | Schneider | 250/316.1 |
| 5,544,582 | 8/1996 | Bocko et al. | 101/483 |
| 5,594,484 | 1/1997 | Furukawa | 347/95 |
| 5,641,558 | 6/1997 | Noda et al. | 428/210 |
| 5,677,370 | 10/1997 | Huber et al. | 524/490 |

FOREIGN PATENT DOCUMENTS

| | | |
|---|---|---|
| 0647885 A1 | 4/1995 | European Pat. Off. . |
| 2238985 | 7/1991 | United Kingdom . |
| 94 15263 | 7/1994 | WIPO . |

OTHER PUBLICATIONS

Noriyoshi, et al., "Recording Method," English–language abstract of Japanese patent JP–A–59–125766 (Jul. 20, 1984).

*Primary Examiner*—Edgar Burr
*Assistant Examiner*—Anthony H. Nguyen

[57] ABSTRACT

A method and apparatus for printing ceramic or glass flat substrate, wherein a fusible powder is applied to an image forming medium in order to form an image thereon which is transferred to an intermediate medium, and the powder image formed on the intermediate medium is brought into contact with the substrate in a contact zone, the ceramic or glass substrate being heated in a pre-heating device before the contact zone to a temperature of at least 60° C., and wherein the intermediate medium in the contact zone is heated to a temperature of at least 100° C.

15 Claims, 1 Drawing Sheet

METHOD AND APPARATUS FOR DECORATING CERAMIC AND GLASS SUBSTRATES AND THE TONER POWDER USED IN SUCH A SYSTEM

BACKGROUND AND SUMMARY OF THE INVENTION

The present invention relates to a method and apparatus for decorating ceramic and glass flat plates and to a toner powder use in such a system. Flat plates or substrates of this kind are processed in an apparatus in which the substrates are moved from one processing station to another and are provided with a print in each of the processing stations. In conventional processing stations for decorating ceramic and glass substrates, use is made, for example, of a screen printing apparatus. For this purpose, a screen has to be made for each series of substrates in order to print the same. In the case of multi-color printing, more of these screens are required.

Making the required screens in this way is extremely complicated and expensive and obstructs rapid change of substrates with different prints. The processing machines have to be stopped for each new image in order to replace the screens and re-start the process.

The decoration of ceramic and glass substrates can also be carried out in accordance with EPT 0 647 885, wherein an electrophotographic method is used to make an intermediate original, e.g. a paper substrate covered with gum Arabic, the intermediate original subsequently being brought into contact with the substrate. The toner image applied to the intermediate original is then transferred to the ceramic or glass substrate in a manner similar to the decalcomania process. The transferred image is then fired into the substrate at high temperature. This method requires considerable manual labor and is time-consuming. The object of the present invention is to drastically reduce the above disadvantages.

To this end, according to the present invention, use is made of a method and apparatus for printing ceramic or glass substrates, wherein a fusible powder is applied to an image forming medium in order to form an image and transferred to an intermediate medium, the powder image on the intermediate medium being brought into contact with the ceramic or glass substrate in a contact zone, the substrate being heated in a preheating device before the contact zone to a temperature of at least 60° C., e.g. 60° to 100° C. and wherein the intermediate medium in the contact zone is heated to a temperature of at least 100° C., e.g. 100° to 140° C. As a result, different images can be applied to the image forming medium in rapid succession and these images can be transferred to the ceramic or glass substrates without stopping the processing machine, thus increasing the machine productivity and providing bonding between the transferred images and the substrates. High quality mechanically resistant decorations are obtained if the image is fired in the ceramic or glass substrate.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
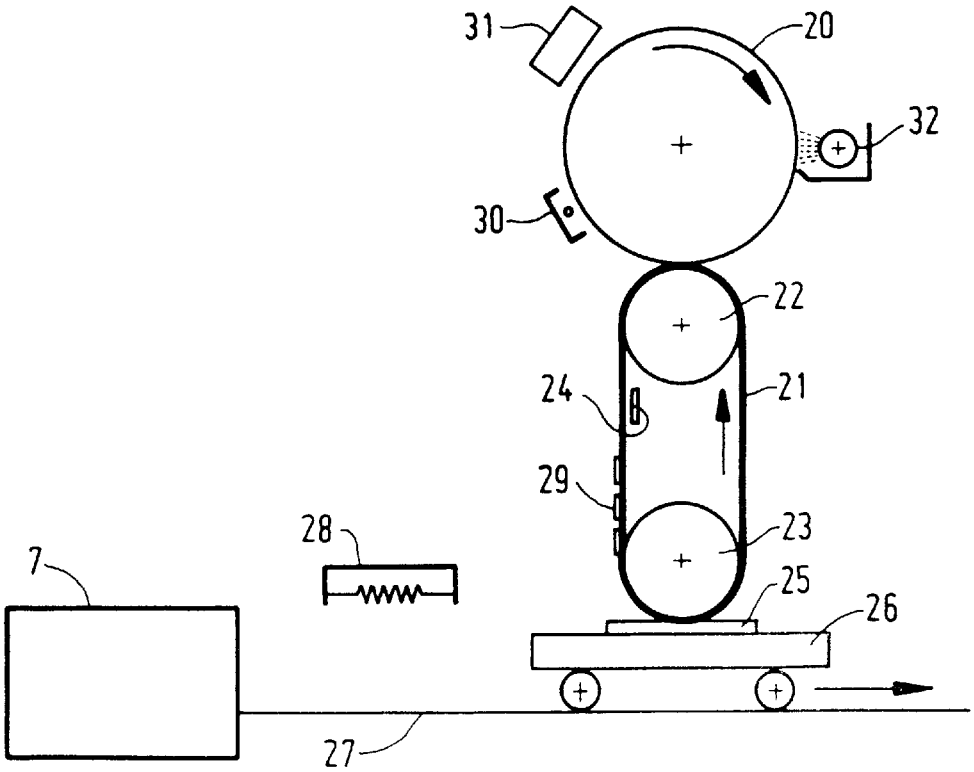
FIG. 1 is a diagram showing an apparatus according to the present invention.

FIG. 1 diagrammatically illustrates an apparatus according to the present invention. A rotatably mounted image forming medium 20 provided with an electrophotographic layer is provided with a uniform charge at charging station 30, said charge being exposed image-wise, for example with a laser, in exposure station 31. The remaining charged image is provided with a fusible powder in developing station 32. This powder image is transferred to an intermediate medium 21 by contact therewith. The intermediate medium 21 is formed by a flexible belt provided with a top layer of silicone rubber and supported by transport rollers 22 and 23. The intermediate medium 21 with the powder image thereon is heated by means of a heater 24 such that the powder on the medium level with the transport roller 23 is in the molten state. It is also possible for the transport roller 23 to be provided, in a manner known to the skilled artisan, with a heating device (not shown) for melting the powder image 29. The holder 26 is provided with transport means which bring the substrates into contact with the powder image 29 on the intermediate medium 21 via a transport path 27. The temperature of the intermediate medium 21 is at least 100° C. in the contact zone. Before contact the substrate is heated in a preheater 28 to a temperature of at least (60° C.

The melted powder image 29 is transferred to the substrate in the contact zone. After the toner image has been completely transferred, the substrate is transported via the transport path 27 to a discharge station (not shown). The apparatus is provided with synchronization means (not shown) which ensure that the powder image recorded and developed on the image forming medium 20 is formed in register with the substrate passing in the contact zone.

It is clear that other image forming techniques can be applied to form a powder image on the image forming medium 20. A suitable technique, for example, is the inductographic technique as described in European Patent 0 191 521. In this document, the drum on which the image-forming medium 20 is located is replaced by a drum provided with a series of electrodes insulated from one another and extending on the periphery of the drum and capable of being fed with a voltage, image-wise, by means of trigger electrodes, said electrodes then being provided with an image-wise powder image by means of a developing station 32 suitable for the purpose.

Figure 2:
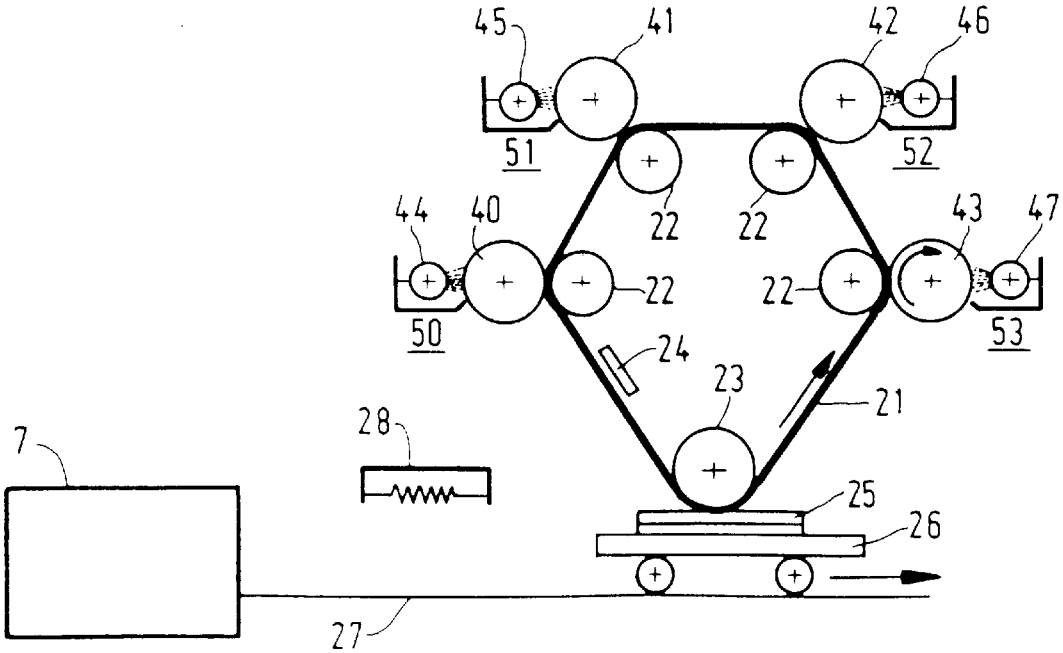
FIG. 2 is a diagram showing an apparatus according to the present invention for printing recording substrates in color, the substrates being in the form of discs.

FIG. 2 diagrammatically illustrates the apparatus according to the present invention for the multi-color printing of substrates by the inductographic principle. The reference numerals used in FIG. 1 are maintained here for like functions or parts. Four image forming media 50–53 are shown around the intermediate medium 21 in the form of a belt and are each provided with an inductographic drum 40–43 and a developing device 44–47. The developing devices 44–47 are each provided with a toner in a separate color, e.g. cyan, magenta, yellow and black or red, yellow, blue and white. The drums 40 to 43 are provided with electrodes extending around the drums in a dielectric layer and are so triggered that the color separation images formed on these drums are transferred in register to the intermediate medium. The color image thus formed by fusible toner powder on the intermediate medium 21 is then again heated by heater 24 and transferred to the passing substrate 25. It is clear that any required number of image forming devices can be used and that they can be provided with the required color toner in order to obtain the required color image on the ceramic or glass substrate.

The image-wise triggering of the image forming devices according to FIGS. 1 and 2 can be effected by well known means. It will generally be effected via a computer or image make-up station on which an image can be made up and the data required for the image are transferred to the image forming devices.

In this way it is possible to give each of the substrates a different print as required, both rapidly and simply.

In the examples indicated, the intermediate medium is a flexible belt provided with a top layer of silicone rubber, but of course it is possible to use a rotatable drum for the purpose and to provide it with silicone rubber. The image forming devices should then be located in accordance with this construction. In order to bring the intermediate medium 21 to the required temperature in the transfer zone, the heater 24 can be disposed in a metal transport roller 23.

A powder consisting of a thermoplastic resin and ceramic pigments can be used as the fusible powder or toner powder. Ceramic pigments are substances which retain their color at very high temperatures and which can be fired in ceramic or glass substrates in order to decorate the same. The ceramic pigments will generally be inorganic color pigments, such as metal oxides (e.g. ZnO, $TiO_2$, CoO, $Al_2O_3$, $Cr_2O_3$ and $Fe_2O_3$) and metal silicates, e.g. zirconium silicates with vanadium, presodium or lead and compounds such as cobalt aluminates and mixtures of these pigments incorporated therein. The thermoplastic resins may be any resins suitable for the purpose, e.g. styrene acrylate resins, polyesters, polyamides, polyurethane, epoxy resins and mixtures of these resins. Also, depending on the developing method, magnetic pigments may be added to the resin and the powder particles can also be provided with electrically conductive material, e.g. carbon black, conductive polymers and conductive tin oxides.

It is advantageous to prevent the above mentioned magnetic pigments from being oxidized during the fusing of the toner powder, by fusing the toner powder in an inert atmosphere or by providing a protective coating on the pigments.

The ceramic and glass flat plates are used inter alia as hot plates, tiles and the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus for printing on a ceramic or glass substrate which comprises in image forming medium, and an intermediate member, means for applying a fusible powder to the image forming medium to form a powder image thereon, means for transferring the powder image to said intermediate medium, a ceramic or glass substrate, means for preheating the substrate to a temperature of at least 60° C., means for bringing the powder image on the intermediate medium into contact with said substrate in a contact zone and means for heating the intermediate medium so that in the contact zone it has a temperature of at least 100° C.

2. The apparatus according to claim 1, wherein the substrate is in the form of a disc and said preheating means heats said disc to a temperature of 60 to 100° C. and the intermediate medium is provided with said heating means so that in the contact zone is has a temperature of 100–140° C.

3. The apparatus according to claim 1, wherein at least three image forming media are provided for receiving a fusible powder image of different colors and wherein said powder images are transferred to the intermediate medium.

4. The apparatus according to claim 3, wherein means are provided for transferring the powder images of all the image forming media to the intermediate medium.

5. The apparatus according to claim 1, wherein the intermediate medium is formed by a flexible belt provided with a top layer of silicone rubber.

6. The apparatus according to claim 5, wherein the belt in the contact zone is conveyed over a metal roller provided with heating means.

7. The apparatus according to claim 1, wherein the fusible powder contains a thermoplastic resin and ceramic color pigments.

8. The apparatus according to claim 7, wherein a magnetic pigment and an electrically conductive material is added to the fusible powder.

9. A method of printing on a ceramic or glass substrate which comprises applying a fusible powder to an image forming medium to form a fusible powder image thereon, transferring the fusible powder image to an intermediate medium, providing a ceramic or glass substrate, preheating the substrate to a temperature of at least 60° C., bringing the powder image on the intermediate medium into contact with said substrate in a contact zone, and heating the intermediate medium so that in the contact zone it has a temperature of at least 100° C.

10. The method of claim 9, wherein the substrate is preheated to a temperature of 60 to 100° C. and the intermediate medium is heated to a temperature of 100–140° C.

11. The method of claim 9 wherein the fusible powder image is applied to at least three image forming media which in turn is transferred to the intermediate medium.

12. The method of claim 11, wherein the fusible powder images are transferred to the intermediate medium in register.

13. The method of claim 9, wherein the fusible powder contains a thermoplastic resin and ceramic color pigments.

14. The method of claim 13, wherein the fusible powder further contains a magnetic pigment and an electrically conductive material.

15. The method of claim 13, wherein the thermoplastic resin is selected from the group consisting of styrene acrylate resins, polyesters, polyamides, polyurethanes, epoxy resins, and mixtures thereof.

* * * * *